US009950818B2

(12) United States Patent
Hsu

(10) Patent No.: US 9,950,818 B2
(45) Date of Patent: Apr. 24, 2018

(54) AUTOMATIC BAGGING MACHINE

(71) Applicant: Eminence Machinery Co., Ltd., Minxiong Township, Chiayi County (TW)

(72) Inventor: Chang-Shuen Hsu, Minxiong Township (TW)

(73) Assignee: Eminence Machinery Co., Ltd., Minxiong Township (TW)

( * ) Notice: Subject to any disclaimer, the term of this patent is extended or adjusted under 35 U.S.C. 154(b) by 465 days.

(21) Appl. No.: 14/797,602

(22) Filed: Jul. 13, 2015

(65) Prior Publication Data

US 2017/0015448 A1 Jan. 19, 2017

(51) Int. Cl.

| | |
|---|---|
| ***B65B 11/04*** | (2006.01) |
| ***B65B 41/10*** | (2006.01) |
| ***B65B 61/06*** | (2006.01) |
| ***B65B 9/02*** | (2006.01) |
| ***B65B 49/16*** | (2006.01) |
| *B65B 35/20* | (2006.01) |
| *B65B 35/24* | (2006.01) |

(52) U.S. Cl.

CPC ..... *B65B 9/026* (2013.01); *B65B 49/16* (2013.01); *B65B 35/20* (2013.01); *B65B 35/24* (2013.01); *B65B 41/10* (2013.01); *B65B 61/06* (2013.01)

(58) Field of Classification Search

CPC ..... B65B 25/24; B65B 9/026; B65B 11/50; B65B 61/06; B65B 61/10; B65B 55/225

USPC ..... 53/204, 372.5, 372.2, 372.7, 372.8, 498, 53/496

See application file for complete search history.

(56) References Cited

U.S. PATENT DOCUMENTS 4,450,668 A * 5/1984 Grossi ..... B65B 11/045 53/176
4,634,066 A * 1/1987 Matsui ..... B65H 67/063 198/351
5,105,602 A * 4/1992 Ono ..... B65B 9/026 53/148
5,175,990 A * 1/1993 Fritschi ..... D01H 9/187 242/473.5
5,209,247 A * 5/1993 Rittershaus ..... A24C 5/20 131/58

(Continued)

*Primary Examiner* — Andrew M Tecco
*Assistant Examiner* — Nicholas Igbokwe
(74) *Attorney, Agent, or Firm* — Alan D. Kamrath; Kamrath IP Lawfirm, P.A.

(57) ABSTRACT

An automatic bagging machine contains: a delivery mechanism, a film transporting mechanism, an ultrasonic cutting mechanism, an electric eye mechanism, a limiting assembly, a clamping mechanism, an air tube assembly, and a pushing mechanism. The delivery mechanism includes a conveying belt and plural fixing mounts on which plural spinning bobbins are fitted. The film transporting mechanism includes two carrying sets, each having a holder on which a film material is fitted. The ultrasonic cutting mechanism includes two cutting sets, two slide rails, two first power motors, and two film cutting sets. The electric eye mechanism includes two support posts, the limiting assembly includes a circular ring and an affix mount, the clamping mechanism includes a clamp portion, a crank shaft, and a second power motor. The air tube assembly includes a first air tube and a second air tube. The pushing mechanism includes a rolling assembly and a transmission assembly.

1 Claim, 10 Drawing Sheets

(56) References Cited

U.S. PATENT DOCUMENTS

| | | | | |
|---|---|---|---|---|
| 6,962,033 | B2 * | 11/2005 | Guzman | B29C 66/73715 53/373.5 |
| 7,262,389 | B2 * | 8/2007 | Irwin | B65B 9/067 156/251 |
| 8,087,220 | B2 * | 1/2012 | Uttaro | B26D 1/565 53/374.6 |
| 2004/0250515 | A1 * | 12/2004 | Rimondi | B65B 9/073 53/451 |
| 2004/0256373 | A1 * | 12/2004 | Irwin | B65B 9/067 219/243 |
| 2006/0117712 | A1 * | 6/2006 | Merken-Schiller | B29C 65/08 53/450 |
| 2007/0261371 | A1 * | 11/2007 | Ballestrazzi | B65B 25/14 53/450 |
| 2010/0154355 | A1 * | 6/2010 | Freudenberg | B65H 19/123 53/389.1 |

* cited by examiner

AUTOMATIC BAGGING MACHINE

BACKGROUND OF THE INVENTION

Field of the Invention

The present invention relates to an automatic bagging machine, and more particularly to the automatic bagging machine which packages plural spinning bobbins consistently.

Description of the Prior Art

A conventional automatic bagging machine is adapted to seal plural spinning bobbins by using a film material and then to cut the plural spinning bobbins, thereafter the plural spinning bobbins are covered, thus packaging the plural spinning bobbins.

However, the conventional automatic bagging machine is operated in several stages to cause labor and material costs, and more particularly to packaging the plural spinning bobbins inconsistently.

The present invention has arisen to mitigate and/or obviate the afore-described disadvantages.

SUMMARY OF THE INVENTION

The primary objective of the present invention is to provide an automatic bagging machine which packages plural spinning bobbins consistently.

Accordingly, an automatic bagging machine provided by the present invention contains: a delivery mechanism, a film transporting mechanism, an ultrasonic cutting mechanism, an electric eye mechanism, a limiting assembly, a clamping mechanism, an air tube assembly, and a pushing mechanism.

The delivery mechanism includes a conveying belt for conveying plural fixing mounts on which plural spinning bobbins are fitted.

The film transporting mechanism includes two carrying sets; wherein each carrying set has a holder on which a film material is fitted and is delivered by a plurality of rollers.

The ultrasonic cutting mechanism includes two cutting sets mounted on the two sides of the delivery mechanism and a rear end of the film transporting mechanism; wherein each cutting set has a slide rail and a first power motor, such that each cutting set is driven by the first power motor to expend and retract on the slide rail, and the film material is fixed, wherein each cutting set also has a film cutting set for cutting the film material.

The electric eye mechanism includes two support posts, and each support post has plural electric eyes vertically arranged thereon; wherein the two support posts are arranged on the delivery mechanism opposite to the film transporting mechanism.

The limiting assembly is secured on a rear end of the ultrasonic cutting mechanism and contains a circular ring and an affix mount.

The clamping mechanism is disposed on the delivery mechanism and is located behind the limiting assembly; the clamping mechanism includes a clamp portion, a crank shaft, and a second power motor.

The air tube assembly is mounted below the delivery mechanism and includes a first air tube and a second air tube.

The pushing mechanism is fixed on the delivery mechanism and includes a rolling assembly and a transmission assembly; wherein the transmission assembly has a push assembly mounted thereon and a sensor fixed thereon corresponding to the push assembly.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
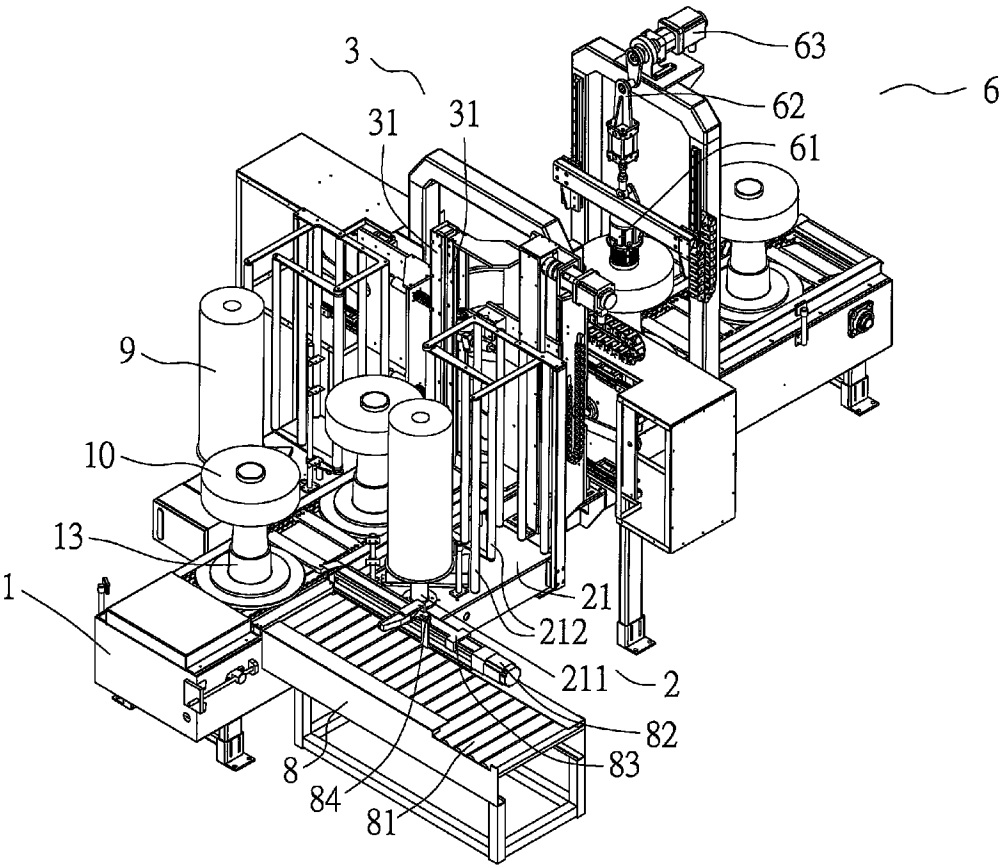
FIG. 1 is a perspective view showing the assembly of an automatic bagging machine in accordance with a preferred embodiment of the present invention.
Figure 2:
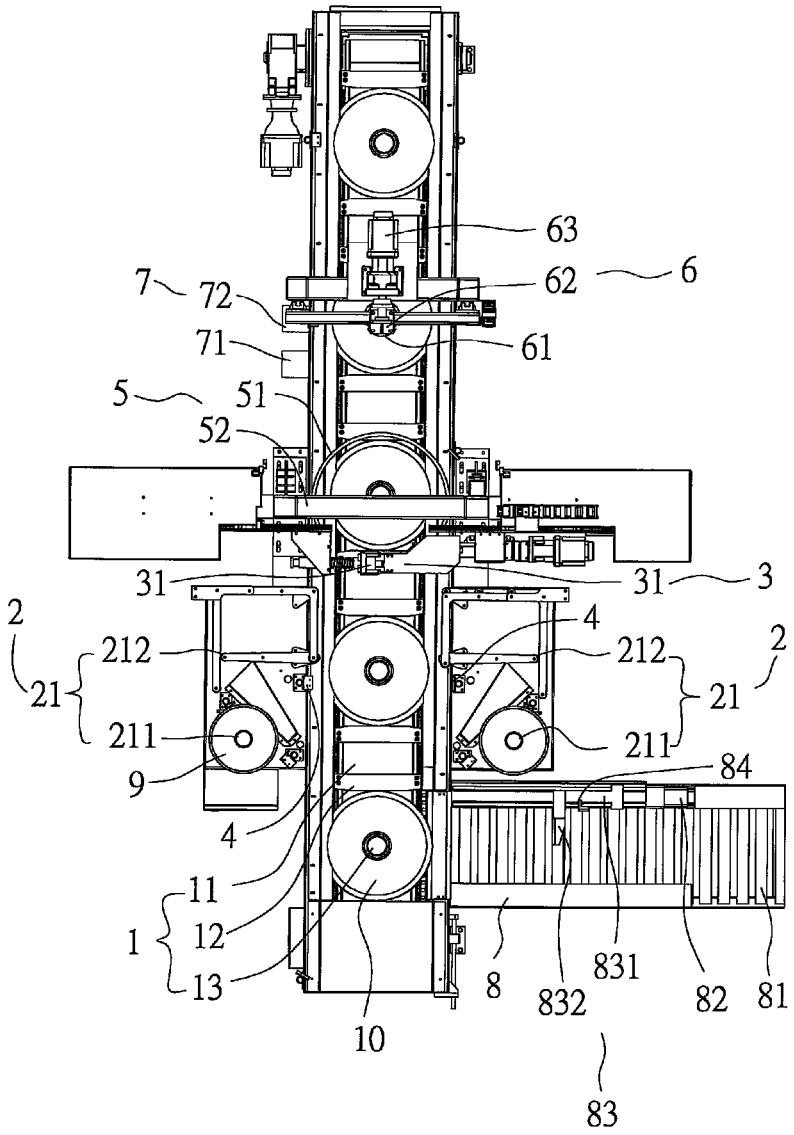
FIG. 2 is a top plan view showing the assembly of the automatic bagging machine in accordance with the preferred embodiment of the present invention.
Figure 3:
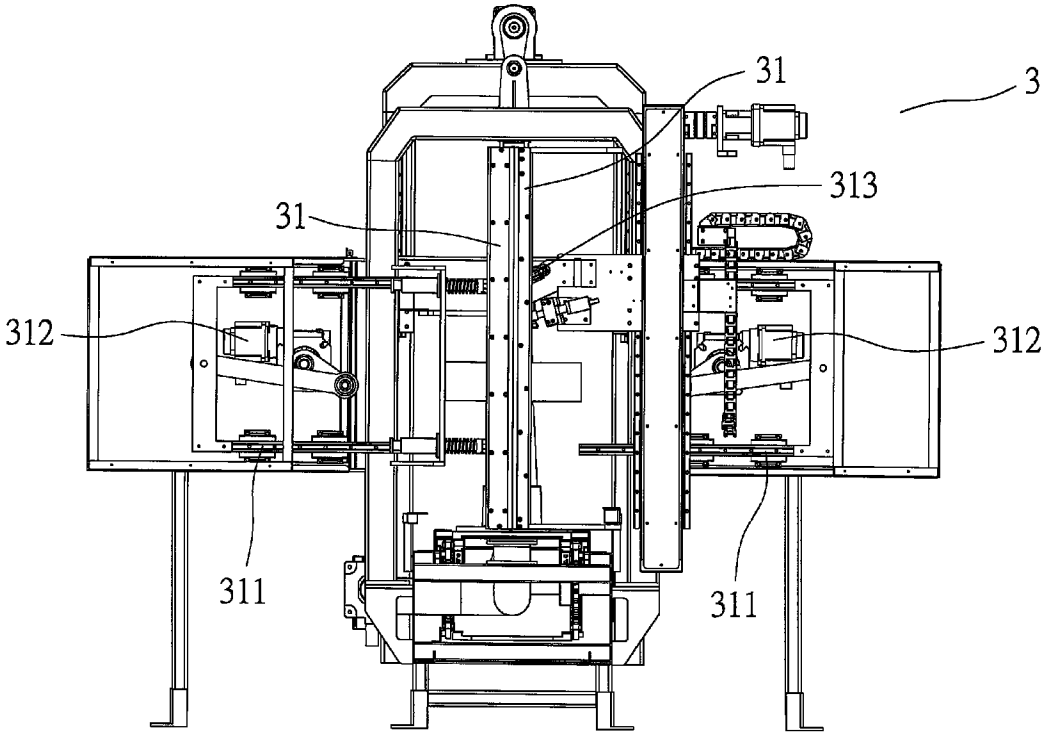
FIG. 3 is a front plan view showing the assembly of the automatic bagging machine in accordance with the preferred embodiment of the present invention.
Figure 4:
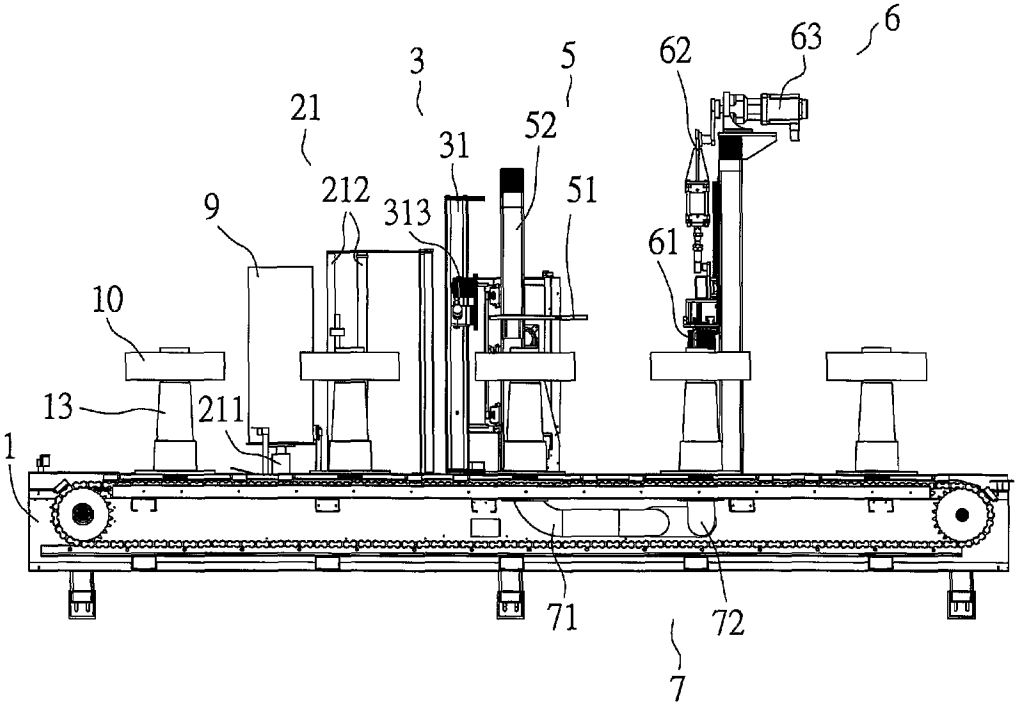
FIG. 4 is a side plan view showing the assembly of the automatic bagging machine in accordance with the preferred embodiment of the present invention.
Figure 5:
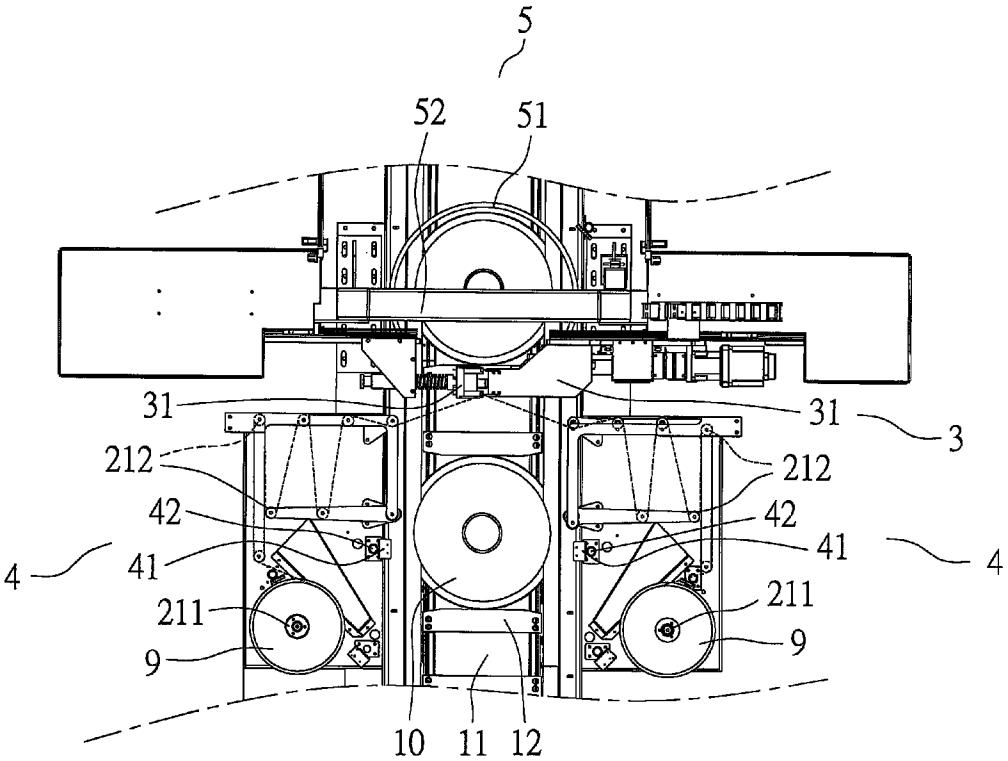
FIG. 5 is a top plan view showing the assembly of a part of the automatic bagging machine in accordance with the preferred embodiment of the present invention.
Figure 6:
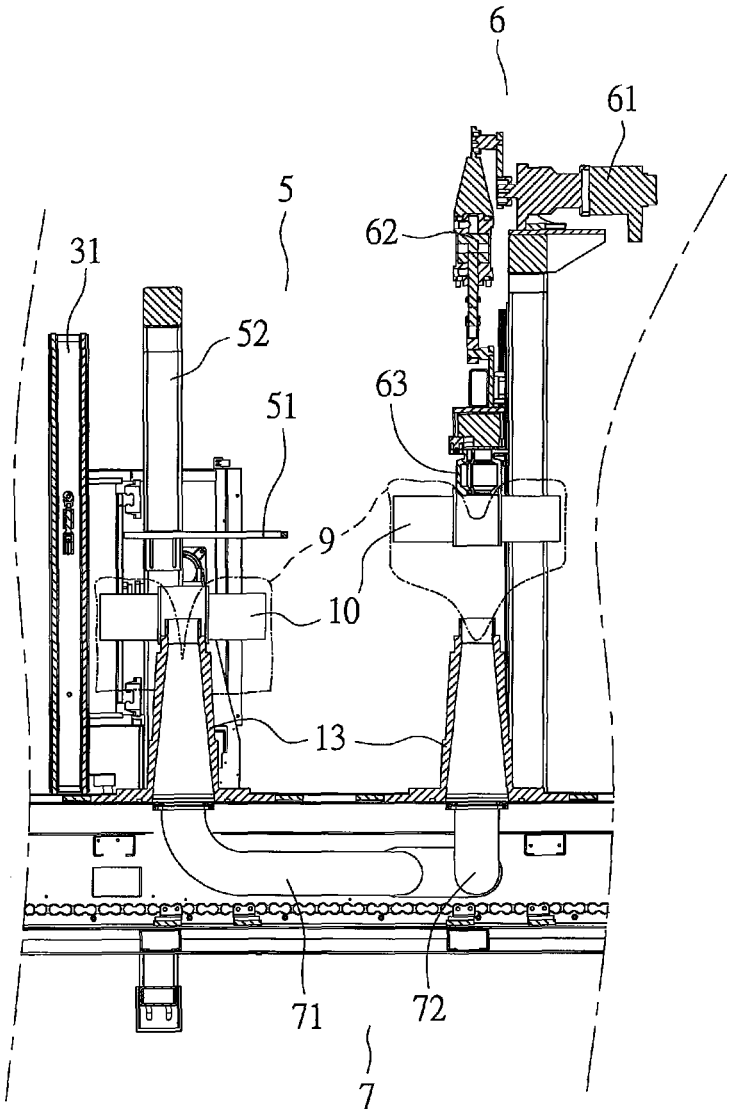
FIG. 6 is a cross sectional view showing the operation of a part of the automatic bagging machine in accordance with the preferred embodiment of the present invention.
Figure 7:
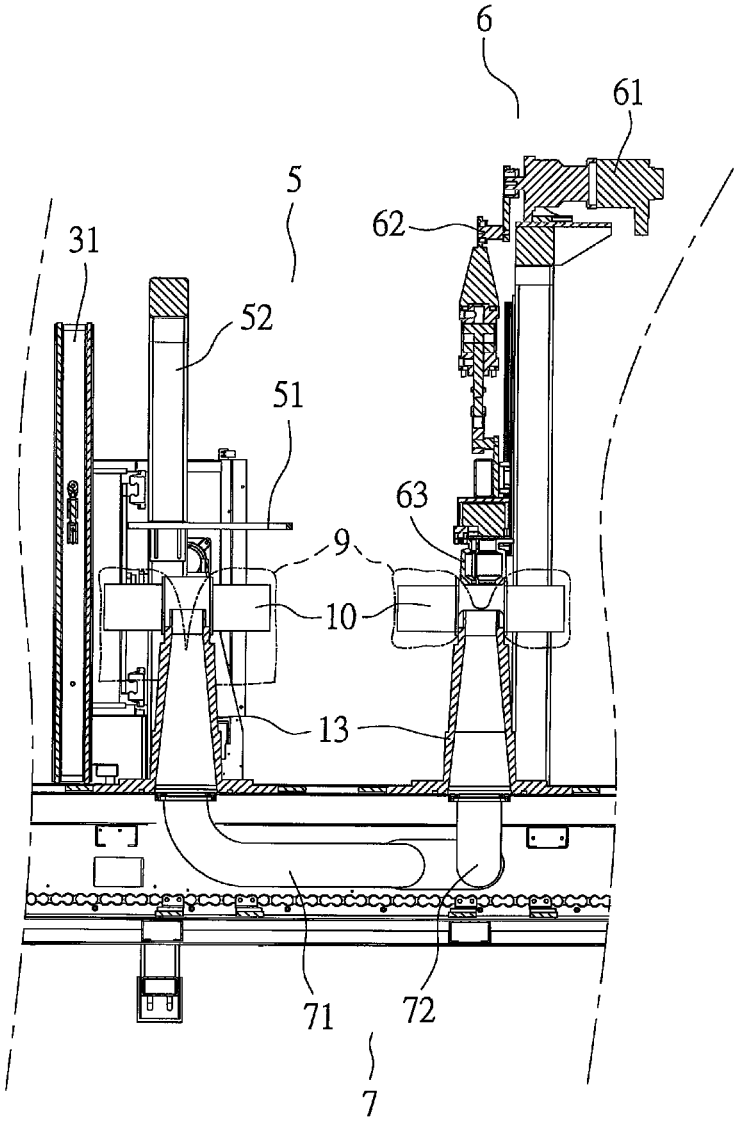
FIG. 7 is another cross sectional view showing the operation of a part of the automatic bagging machine in accordance with the preferred embodiment of the present invention.

With reference to FIGS. 1 and 2, an automatic bagging machine according to a preferred embodiment of the present invention comprises:

a delivery mechanism 1 including a conveying belt 11, a plurality of abutting elements 12 horizontally arranged thereon, and plural fixing mounts 13, wherein each fixing mount 13 is defined between each two of the plurality of abutting elements 12;

a film transporting mechanism 2 including two carrying sets 21, wherein each carrying set 21 is arranged on each of two sides of the delivery mechanism 1 and has a holder 211 on which a film material 9 is fitted and is delivered by a plurality of rollers 212;

an ultrasonic cutting mechanism 3 including two cutting sets 31 mounted on the two sides of the delivery mechanism 1 and a rear end of the film transporting mechanism 2, wherein each cutting set 31 has a slide rail 311 and a first power motor 312, such that each cutting set 31 is driven by the first power motor 312 to expend and retract on the slide rail 311, and the film material 9 is fixed, wherein each cutting set 31 also has a film cutting set 313 for cutting the film material 9 (as shown in FIG. 3);

an electric eye mechanism 4 including two support posts 42, and each support post 42 having plural electric eyes 41 vertically arranged thereon, wherein the two support posts 42 are arranged on the delivery mechanism 1 opposite to the film transporting mechanism 2; and wherein the plural electric eyes 41 are employed to judge a height of plural spinning bobbins 10 (as shown in FIG. 5);

a limiting assembly 5 secured on a rear end of the ultrasonic cutting mechanism 3 and comprised of a circular ring 51 and an affix mount 52 to limit the film material 9 surrounded by the plural spinning bobbins 10 within a certain range to save a consumption of the film material 9;

a clamping mechanism 6 disposed on the delivery mechanism 1 and located behind the limiting assembly 5, the clamping mechanism 6 including a clamp portion 61, a crank shaft 62, and a second power motor 63, wherein the second power motor 63 drives the crank shaft 62 by which the clamp portion 62 is driven to clamp the plural spinning bobbins 10 to move upwardly and downwardly.

an air tube assembly 7 mounted below the delivery mechanism 1 and including a first air tube 71 and a second air tube 72 which are fixed below the plural fixing mounts 13 to suck an upper opening end of the film material 9, wherein the first air tube 71 and the second air tube 72 draw a lower opening end of the film material 9 by matching with the clamping mechanism 6 (as shown in FIG. 4);

a pushing mechanism 8 including a rolling assembly 81, a transmission assembly 82 disposed on one side of the transmission assembly 82, a push assembly 83 mounted on the transmission assembly 82, and a sensor 84 fixed on the transmission assembly 82 and corresponding to the push assembly 83. Preferably, the pushing mechanism 8 is connected with one side of a front end of the delivery mechanism 1, and the push assembly 83 has a driving member 832 rotatably and vertically connected with a movable plate 831, the movable plate 831 is fixed on the transmission assembly 82.

Figure 8:
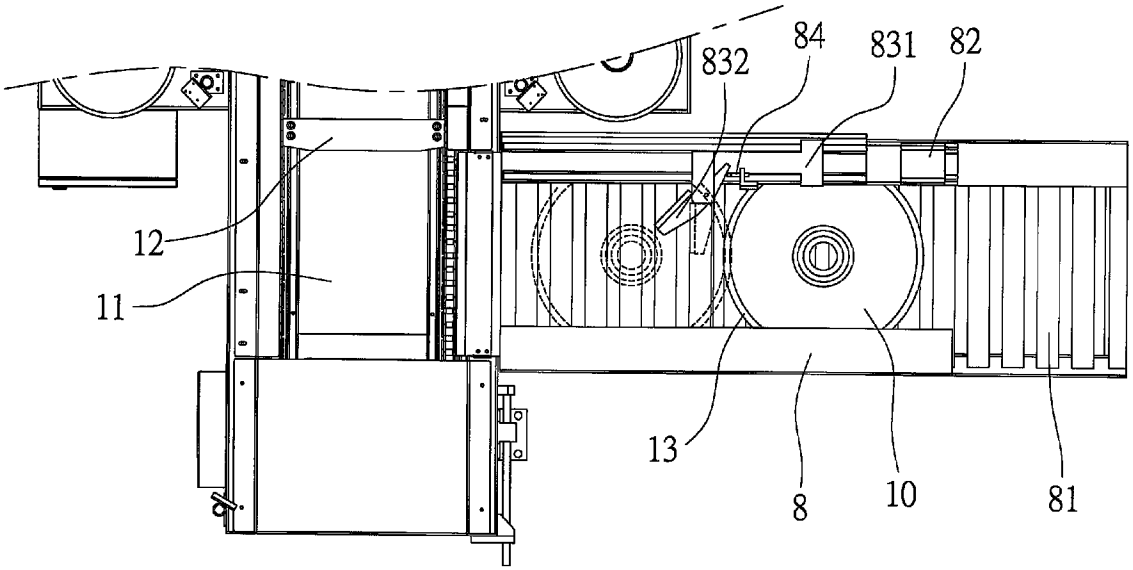
FIG. 8 is a side plan view showing the operation of a part of the automatic bagging machine in accordance with the preferred embodiment of the present invention.
Figure 9:
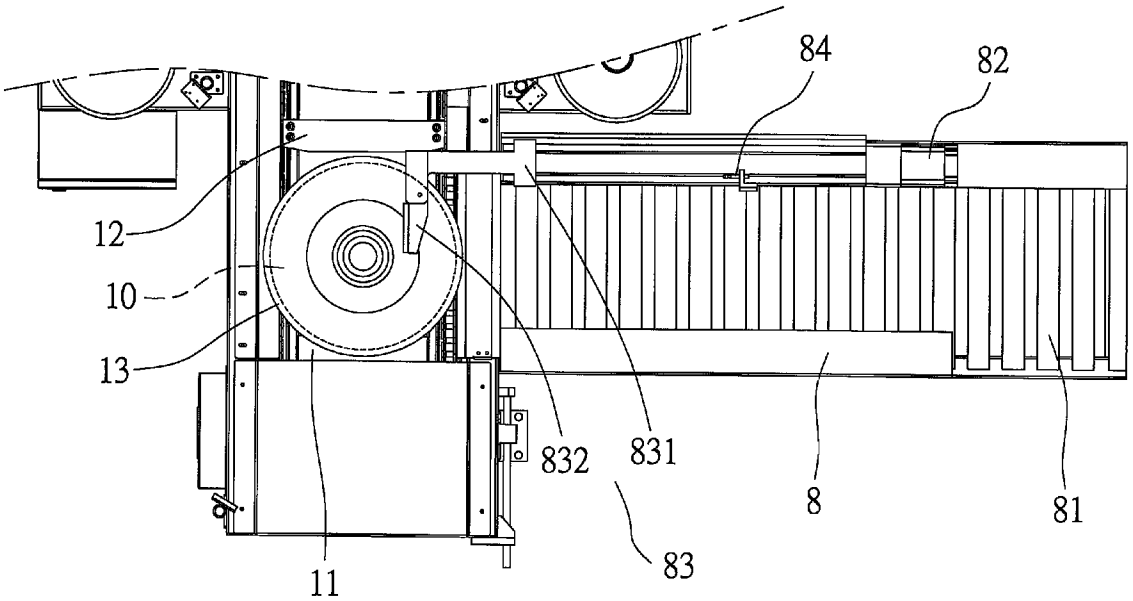
FIG. 9 is another side plan view showing the operation of a part of the automatic bagging machine in accordance with the preferred embodiment of the present invention.

Referring to FIGS. 8 and 9, in operation, the rolling assembly 81 of the pushing mechanism 8 drives each fixing mount 13 of each spinning bobbin 10 to move across the push assembly 83, and each fixing mount 13 touches a first end of the movable plate 831 so that a second end of the movable plate 831 moves reversely and contacts with the sensor 84 to drive the transmission assembly 82, and the movable plate 831 drives the driving member 832 to move, such that each fixing mount 13 is pushed forward, hence each fixing mount 13 is retained between each two of the plurality of abutting elements 12 on the conveying belt 11 of the delivery mechanism 1, and the transmission assembly 82 pushes the driving member 832 back to an original position, thus pushing a next fixing mount 13.

Figure 11:
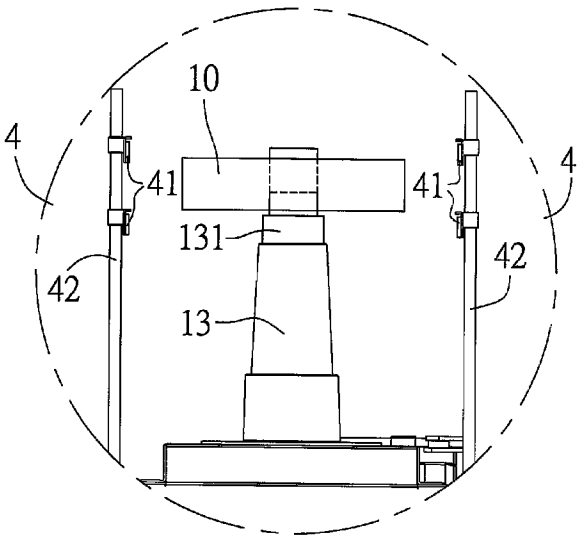
FIG. 11 is still another side plan view showing the operation of a part of the automatic bagging machine in accordance with the preferred embodiment of the present invention.
Figure 10:
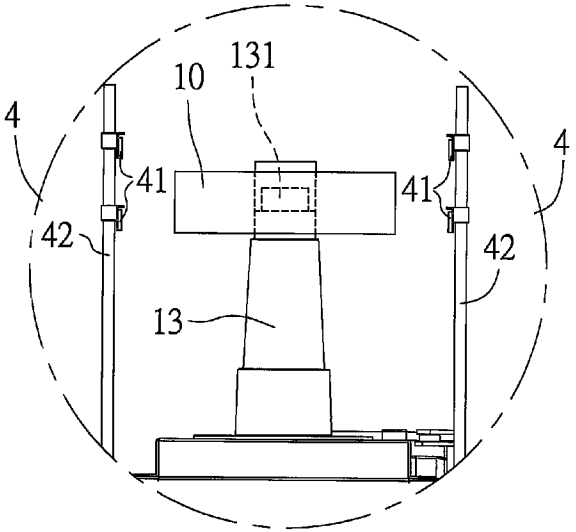
FIG. 10 is also another side plan view showing the operation of a part of the automatic bagging machine in accordance with the preferred embodiment of the present invention.

Each fixing mount 13 has two stepped sections 131 (as illustrated in FIGS. 10 and 11) to fit the plural spinning bobbins 10 of different sizes, and the plural electric eyes 41 sense the plural spinning bobbins 10 to judge the height of the plural spinning bobbins 10 so that the clamping mechanism 6 clamp the plural spinning bobbins 10 at different depths.

As shown in FIGS. 4 to 7, each fixing mount 13 is transmitted by the conveying belt 11 to move through the film material 9 fitted on the film transporting mechanism 2, thus finishing an arrangement of the plural spinning bobbins 10. After the plural spinning bobbins 10 move across the ultrasonic cutting mechanism 3, the limiting assembly 5 limits the film material 9 within a range, and the two cutting sets 31 mounted on two sides of the ultrasonic cutting mechanism 3 cut the film material 9 by using the film cutting sets 313 of each cutting set 31, and when the film material 9 moves to the air tube assembly 7, the first air tube 71 draws the upper opening end of the film material 9 into an axle center of each spinning bobbin 10, wherein the film material 9 moves to the second air tube 72, the clamp portion 61 of the clamping mechanism 6 clamps each spinning bobbin 10, and each spinning bobbin 10 is moved upwardly and downwardly by using the crank shaft 62 and the second power motor 63, wherein when each spinning bobbin 10 is moved upwardly, the lower opening end of the film material 9 is drawn into an axle center of each fixing mount 13, and after each spinning bobbin 10 is moved downwardly, the lower opening end of the film material 9 is inserted into the axle center of each spinning bobbin 10, thereafter each spinning bobbin 10 is fitted on each fixing mount 13, thus packing each spinning bobbin 10 consistently.

While we have shown and described various embodiments in accordance with the present invention, it is clear to those skilled in the art that further embodiments may be made without departing from the scope of the present invention.

What is claimed is:

1. An automatic bagging machine comprising: a delivery mechanism including a conveying belt for conveying plural fixing mounts on which plural spinning bobbins are fitted;

a film transporting mechanism including two carrying sets; wherein each carrying set has a holder on which a film material is fitted and is delivered by a plurality of rollers;

an ultrasonic cutting mechanism including two cutting sets mounted on the two sides of the delivery mechanism and a rear end of the film transporting mechanism; wherein each cutting set has a slide rail and a first power motor, such that each cutting set is driven by the first power motor to expend and retract on the slide rail, and the film material is fixed, wherein each cutting set also has a film cutting set for cutting the film material;

an electric eye mechanism including two support posts, and each support post having plural electric eyes vertically arranged thereon; wherein the two support posts are arranged on the delivery mechanism opposite to the film transporting mechanism; and wherein the plural electric eyes are configured to judge a height of the plural spinning bobbins a limiting assembly secured on a rear end of the ultrasonic cutting mechanism and comprised of a circular ring and an affix mount, wherein the limiting assembly is configured to limit the film material surrounded by the plural spinning bobbins within a certain range;

a clamping mechanism disposed on the delivery mechanism and located behind the limiting assembly; the clamping mechanism including a clamp portion, a crank shaft, and a second power motor, wherein the clamping mechanism is configured to clamp each spinning bobbin;

an air tube assembly mounted below the delivery mechanism and including a first air tube and a second air tube which are fixed below the plural fixing mounts to suck an upper opening end of the film material;

a pushing mechanism fixed on the delivery mechanism and including a rolling assembly and a transmission assembly; wherein the transmission assembly has a push assembly mounted thereon and a sensor fixed thereon corresponding to the push assembly.

* * * * *